US005818320A

United States Patent [19]

Matsuoka

[11] Patent Number: 5,818,320

[45] Date of Patent: Oct. 6, 1998

[54] FUSE ASSEMBLY WITH REMOVABLE FUSIBLE ELEMENT

[75] Inventor: Naoki Matsuoka, Shizuoka, Japan

[73] Assignee: Yazaki Corporation, Tokyo, Japan

[21] Appl. No.: 939,204

[22] Filed: Sep. 29, 1997

[51] Int. Cl.[6] ..... H01H 85/044; H01H 85/045

[52] U.S. Cl. ..... 337/198; 337/227; 337/251; 337/252; 337/217

[58] Field of Search ..... 337/158–166, 337/198, 227, 251, 252, 290, 295, 296, 217, 260–264

[56] References Cited

U.S. PATENT DOCUMENTS

| | | | |
|---|---|---|---|
| 4,672,352 | 6/1987 | Takano | 337/264 |
| 4,830,631 | 5/1989 | Hsueh | 439/622 |
| 5,668,521 | 9/1997 | Oh | 337/186 |

FOREIGN PATENT DOCUMENTS 54-133343 9/1979 Japan .

*Primary Examiner*—Leo P. Picard
*Assistant Examiner*—Anatoly Vortman
*Attorney, Agent, or Firm*—Morgan, Lewis & Bockius LLP

[57] ABSTRACT

A fuse having a pair of blade-type male terminals inserted into one opening of a fuse housing, which is made of synthetic resin, having a through hole. An element portion of the fuse is removably inserted into the other opening of the housing. The element portion includes a pair of leg portions fitted at their distal ends in element holding portions on the terminals. A fusible portion interconnecting proximal ends of the leg portions and one end of a connecting portion extending in a direction opposite to a direction of extending of the terminals. A heat-radiating plate portion is formed integrally on the other end of the connecting portion, and is covered with a cover. The cover is exposed exteriorly of the housing when the element portion is inserted into the housing.

6 Claims, 5 Drawing Sheets

FUSE ASSEMBLY WITH REMOVABLE FUSIBLE ELEMENT

BACKGROUND OF THE INVENTION

1. Field of the Invention

The present invention relates to a fuse used in electric wiring in an automobile or the like, and more particularly to a fuse of the type in which a fusible portion is provided separately from the other portions.

2. Description of Related Art

In the electric circuit in the automobile or the like, the blade-type (tongue-like terminal-type) fuse, having an excellent mechanical strength, has been extensively used instead of the conventional cylindrical fuse. As shown in FIG. 7, in this fuse 1, a pair of blade-type male terminals 7 and 7, interconnected by a fusible portion 5, are inserted into a housing 3 made of synthetic resin through an upper opening 9 or a lower opening 9, and this opening 9 is closed by a cover 11 or a cover 13 (see FIG. 9), thereby assembling the fuse as shown in FIGS. 8 or 9.

In this fuse 1, the blade-type male terminals 7 and 7 need to have such a proper thickness as to withstand the insertion and withdrawal relative to their mating terminals whereas the fusible portion 5 is formed with a smaller thickness so that it can be melted. Therefore, for forming the fusible portion 5 and the blade-type male terminals 7 and 7, the prior cutting applies to that portion of a stock corresponding to the fusible portion, and then an integral structure, having the pair of blade-type male terminals 7 and 7 interconnected by the fusible portion 5 of a predetermined electrical capacity, is punched from the stock by a press.

In use, the fuse 1 of this construction, having a predetermined capacity, is inserted into a terminal receiving chamber of a fuse holder having female terminals (not shown) mounted therein. When the fusible portion 5 of the fuse 1 is melted by an excess current, it is replaced by a new one, and is discarded.

In the above conventional fuse 1, however, that portion of the stock corresponding to the fusible portion 5 is cut, and then the fusible portion 5 is punched by the press, thus forming the fusible portion 5 integral with the blade-type male terminals 7 and 7. Therefore, there has been encountered a problem that cumbersome processings (particularly, the cutting operation) are required, and therefore much time and labor have been required for the manufacture.

And besides, when the fusible portion 5 is melted, the fuse itself is replaced by a new one, and therefore the other members, including the housing 3, the cover 11 or the cover 13 and the blade-type male terminals 7 and 7, which can still be used, must be discarded, and this is wasteful and uneconomical.

Furthermore, when the above fuse 1 is in use, the fusible portion 5 is received in the housing 3, and this housing 3 is inserted into the terminal receiving chamber of the fuse holder, and therefore its heat-radiating properties are poor, which has introdused a problem that heat is accumulated within the housing 3, so that the temperature rises even in the steady state.

SUMMARY OF THE INVENTION

The present invention has been made in view of the above problems, and an object of the invention is to provide a fuse in which processings are easy, and those members, which are still usable, can be re-used, and heat-radiating properties can be enhanced.

The above object has been achieved by a fuse of the present invention provided in that:

a housing of synthetic resin having a through hole;

a pair of terminals inserted into the through hole in the housing, each of the terminals having an element holding portion;

an element portion removably inserted into the through hole in the housing, the element portion including a pair of leg portions fitted at their distal ends in the element holding portions, respectively, and a fusible portion interconnecting proximal ends of the leg portions and one end of a connecting portion extending in a direction opposite to a direction of extending of the leg portions; and a cover mounted on the other end of the connecting portion, the cover being exposed exteriorly of the housing when the element portion is inserted in the housing.

Preferably, a heat-radiating plate portion is formed integrally on the other end of the connecting portion, and is covered with the cover.

In the fuse of this construction, when the element portion is inserted into the housing having the terminals fixed thereto, the leg portions of the element portion are fitted respectively in the element holding portions, thereby forming a fuse circuit. In use, the fuse of a predetermined capacity is inserted into a fuse holder, and when the fusible portion is melted by an excess current, the element portion is withdrawn from the housing, and a new element portion is inserted into the housing, thus completing the exchange of the fuse. Therefore, the housing and the terminals are not discarded, but are re-used.

In the fuse having the heat-radiating plate portion formed integrally on the other end of the connecting portion, the housing is inserted into the fuse holder, and the cover is exposed exteriorly of the fuse holder, and heat, generated at the fusible portion in a steady state, is radiated to the exterior through the heat-radiating plate portion in the cover.

DETAILED DESCRIPTION OF THE PREFERRED EMBODIMENTS

A preferred embodiment of a fuse of the present invention will now be described in detail with reference to the drawings.

Figure 1:
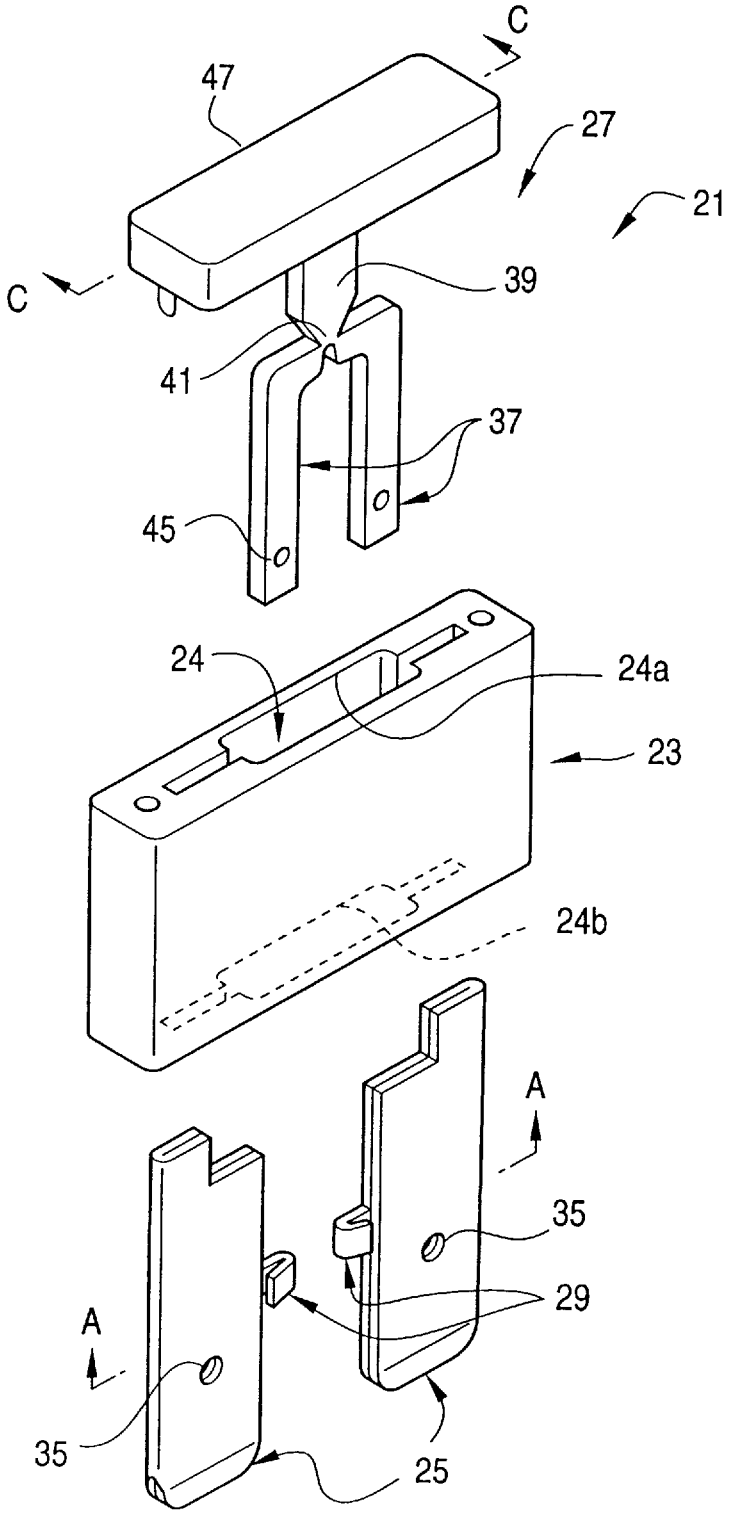
FIG. 1 is an exploded perspective view of a fuse of the present invention.
Figure 2:
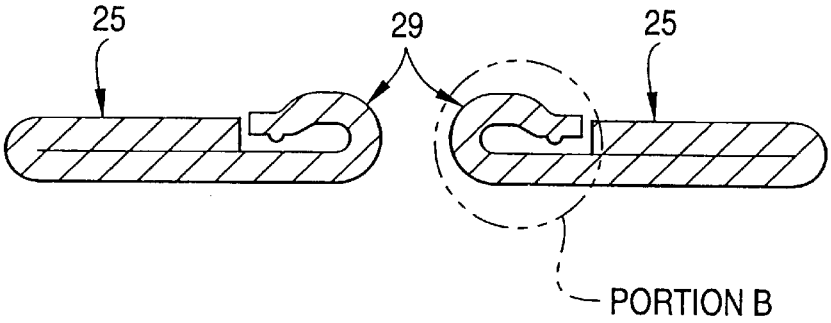
FIG. 2 is a cross-sectional view taken along the line A—A of FIG. 1.
Figure 3:
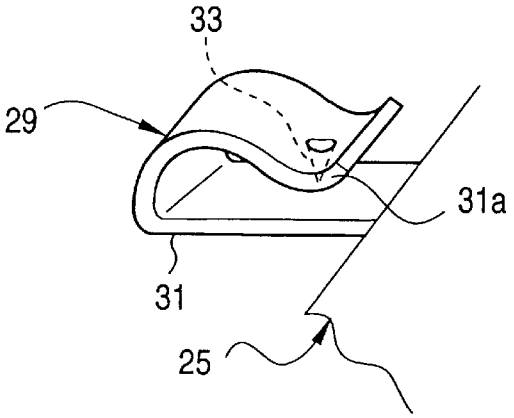
FIG. 3 is an enlarged view of a portion B of FIG. 2.
Figure 4:
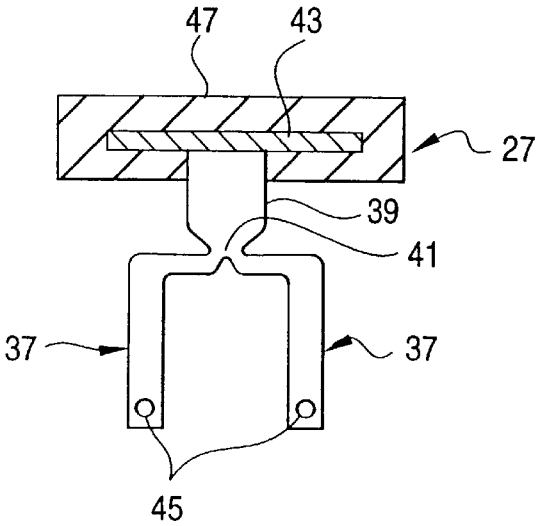
FIG. 4 is a cross-sectional view taken along the line C—C of FIG. 1.
Figure 5:
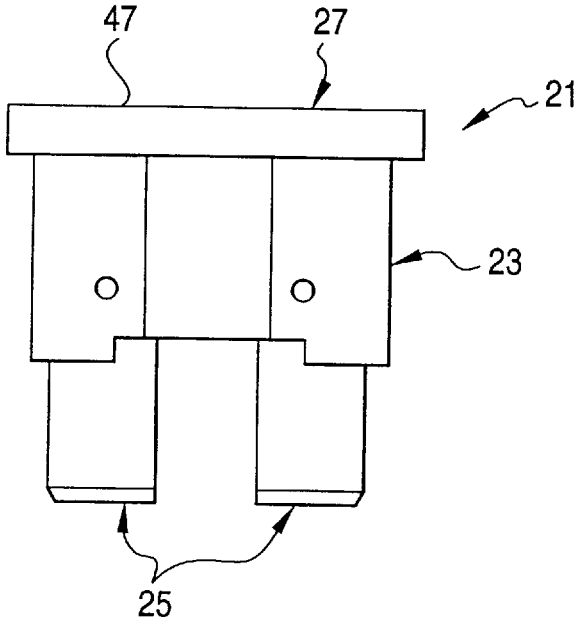
FIG. 5 is a front view showing the appearance of the fuse of FIG. 1 in its assembled condition.
Figure 6:
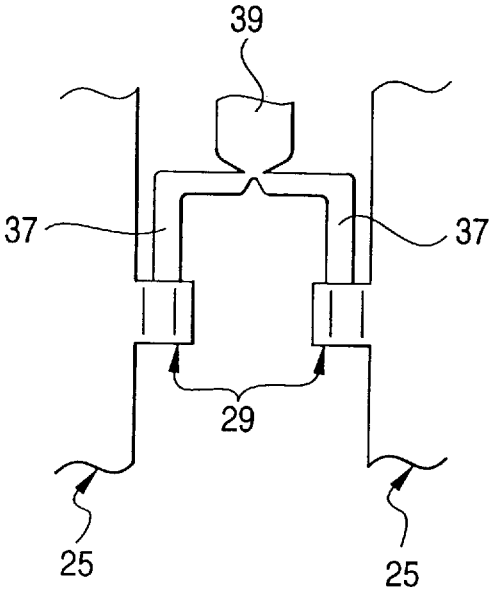
FIG. 6 is a fragmentary, enlarged view showing a fitted condition of the element portion.
Figure 7:
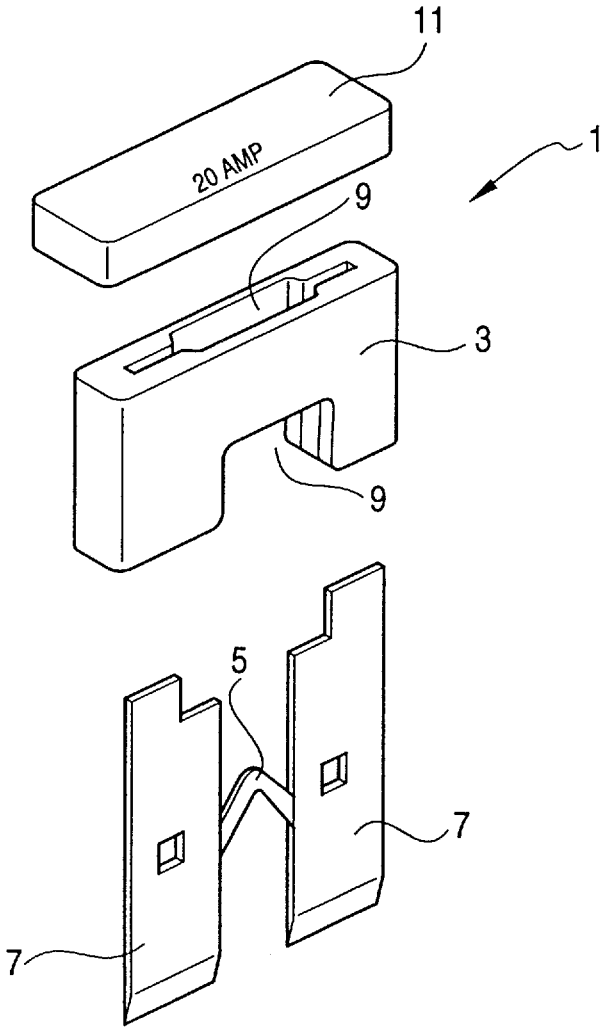
FIG. 7 is an exploded perspective view of a conventional fuse.
Figure 8:
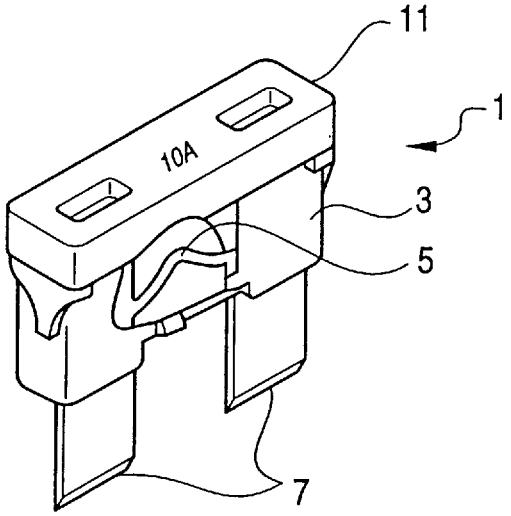
FIG. 8 is a perspective view showing the appearance of the fuse of FIG. 7 in its assembled condition.
Figure 9:
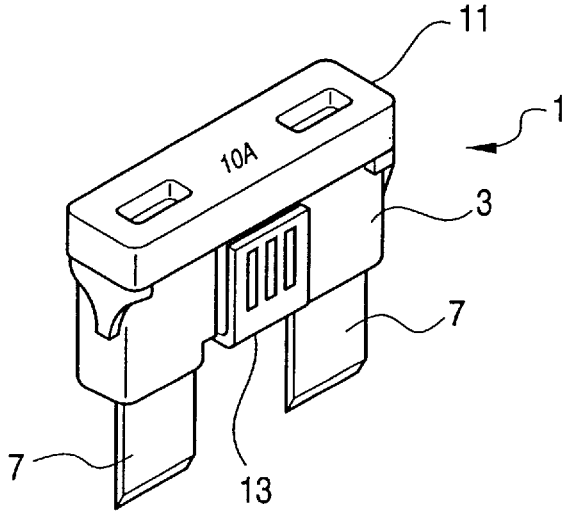
FIG. 9 is a perspective view showing the appearance of another example of conventional fuse in its assembled condition.

FIG. 1 is an exploded perspective view of the fuse of the present invention, FIG. 2 is a cross-sectional view taken along the line A—A of FIG. 1, FIG. 3 is an enlarged view of a portion B of FIG. 2, FIG. 4 is a cross-sectional view taken along the line C—C of FIG. 1, FIG. 5 is a front view showing the appearance of the fuse of FIG. 1 in its assembled condition, and FIG. 6 is a fragmentary enlarged view showing a fitted condition of an element portion.

The fuse 21 broadly includes a housing 23 made of synthetic resin, a pair of blade-type male terminals 25 and 25, and an element portion 27.

The housing 23 includes a square plate having a predetermined thickness. The housing 23 has a through hole 24 formed therethrough in a vertical direction (when this housing is erected in the vertical direction), and this through hole 24 is open at its upper opening 24*a* to an upper end surface of the housing 23, and also is open at its lower opening 24*b* to a lower end surface of the housing. The upper opening 24*a* and the lower opening 24*b* serve respectively as insertion openings for inserting the element portion 27 and the blade-type male terminals 25 therethrough.

As shown in FIG. 2, each of the blade-type male terminals 25 and 25 are formed by bending one half portion of an conductive metal plate (base material) through 180 degrees to be folded upon the other half portion. Element holding portions 29 are formed respectively on inner edges of the blade-type male terminals 25 and 25 disposed in a common plane in parallel relation to each other. As shown in FIG. 3, the element holding portion 29 is formed by folding a distal end portion 31*a* of a piece portion 31 (extending from one edge of the base material) back upon a proximal end portion thereof. The distal end portion 31*a* of the element holding portion 29 is resiliently movable toward and away from the proximal end portion thereof. A projection 33 is formed on the distal end portion 31*a* of the element holding portion 29, and projects toward the proximal end portion of the element holding portion 29. With this construction, the blade-type male terminals 25 and 25 can be produced without the need for a cutting operation.

Generally upper half portions of the blade-type male terminals 25 and 25 are inserted into the housing 23, for example, through the lower opening 24*b* in the housing 23. Through holes 35 are formed respectively through the blade-type male terminals 25 and 25. After the blade-type male terminals 25 and 25 are inserted into the housing 23, the through holes 35 are fused to the housing 23 Namely, the blade-type male terminals 25 and 25, inserted into the housing 23, are integrally fixed to the housing 23.

The element portion 27 includes a pair of parallel leg portions 37 and 37 formed from conductive metal plate, a connecting portion 39 extending in a direction opposite to the direction of extending of the leg portions 37 and 37, a fusible portion 41 interconnecting proximal ends of the leg portions 37 and 37 and one end of the connecting portion 39, and a heat-radiating plate portion 43 formed at the other end of the connecting portion 39. Engagement recesses 45 are formed respectively in distal end portions of the leg portions 37 and 37, and these engagement recesses 45 are engaged respectively with the projections 33 formed respectively on the distal end portions 31*a* of the element holding portions 29.

The leg portions 37 and 37, the connecting portion 39, the fusible portion 41 and the heat-radiating plate portion 43 of the element portion 27 are formed from conductive plate having a uniform thickness, and a desired rated capacity can be obtained by suitably determining the overall thickness and a cross-sectional shape of the fusible portion 41.

A cover 47 is provided to embrace the heat-radiating plate portion 43. The cover 47 is press-fitted on the heat-radiating plate portion 43, or is molded integrally with the heat-radiating plate portion 43. When the cover 47 is molded integrally with the heat-radiating plate portion 43, it is preferred to coat an insulating material (not shown) on the surface of the heat-radiating plate portion 43.

The operation of the fuse 21 of the above construction will now be described.

The fuse 21 is assembled by inserting the element portion 27 into the housing 23 having the blade-type male terminals 25 and 25 fixed thereto. The leg portions 37 and 37 of the element portion 27 are inserted into the housing 23 through the upper opening 24*a*, and the cover 47 is attached to the housing 23, and at the same time the distal end portions of the leg portions 37 and 37 are fitted respectively in the element holding portions 29, thereby forming a fuse circuit as shown in FIG. 6.

In use, the thus assembled fuse 21 having predetermined capacity, is inserted into a terminal receiving chamber of a fuse holder having female terminals (not shown) mounted therein as shown in FIG. 5. When the fuse 21 is thus inserted into the fuse holder, the housing 23 is received in the fuse holder while the cover 47 is exposed to the exterior of the fuse holder. Therefore, heat, generated at the fusible portion 41 in the steady state, is radiated to the exterior through the heat-radiating plate portion 43 in the cover 47. Therefore, the heat will not be accumulated within the housing 23, and the temperature of the fuse will not rise.

When the fusible portion 41 is melted by an excess current, the fuse 21 is removed from the fuse holder. The cover 47 of the thus removed fuse 21 is held by hand, and the element portion 27 is withdrawn from the housing 23, and a new element portion 27 is inserted into the housing 23 through the upper opening 24*a*, thus completing the exchange of the fuse.

Therefore, the housing 23 and the blade-type male terminals 25 do not need to be discarded, but can be re-used. In a certain type of fuse holder, the fuse 21 does not need to be removed from the fuse holder, and only the element portion 27 can be exchanged, with the fuse kept mounted in the fuse holder.

In the above fuse 21, the blade-type male terminals 25, which are required to have the suitable thickness from the viewpoint of the strength, are separate from the fusible portion 41 which is usually smaller in thickness than these terminals 25, and the blade-type male terminal 25 is formed into the increased thickness by folding the base sheet. Therefore, there is no need to effect a cutting operation for providing the structure in which the blade-type male terminals are integral with the fusible portion as in the conventional construction, and therefore the processing is easy.

When the fusible portion 41 is melted, it is only necessary to exchange the element portion 27, and therefore the housing 23, the blade-type male terminals 25 and so on, which have been discarded in the conventional construction, can be re-used, and a waste is eliminate, and the resource is saved, and the economy is enhanced.

Furthermore, in the above fuse 21, the heat-radiating plate portion 43 is formed on the connecting portion 39 connected to the fusible portion 41, and this heat-radiating plate portion 43 is exposed exteriorly of the housing 23, and therefore the heat, generated at the fusible portion 41 in the steady state, can be radiated to the exterior through the heat-radiating plate portion 43 in the cover, thereby enhancing the heat-radiating effect.

And besides, the above fuse 21 achieves the following effects. Namely, merely by exchanging the element portion 27, the rating of the fuse 21 can be changed.

The upper opening 24*a* and the lower opening 24*b* are formed respectively in the upper and lower ends of the housing 23, and therefore the housing 23 can be used for the type in which the blade-type male terminals 25 are inserted from the upper side of the housing 23 and also for the type in which the blade-type male terminals are inserted from the lower side of the housing.

The housing 23 can be molded integrally with the blade-type male terminals 25, and in this case, it is only necessary to insert the element portion 27 at a later step of the assembling process, and the time and labor, required for the assembling operation, is reduced, and therefore the cost is reduced.

What is claimed is:

1. A fuse comprising:

a housing having a through hole;

a pair of terminals inserted into said through hole in said housing, each of said terminals having an element holding portion;

an element portion removably inserted into said through hole in said housing, said element portion including a pair of leg portions fitted at their distal ends in said element holding portions, respectively, and a fusible portion interconnecting proximal ends of said leg portions and one end of a connecting portion extending in a direction opposite to a direction of extending of said leg portions; and a cover mounted on the other end of said connecting portion, said cover being exposed exteriorly of said housing when said element portion is inserted in said housing.

2. A fuse according to claim 1, in which said housing is made of synthetic resin.

3. A fuse according to claim 1, in which a heat-radiating plate portion is formed integrally on the other end of said connecting portion, and is covered with said cover.

4. A fuse according to claim 1, in which each of said terminals are formed by bending one half portion of a base material through 180 degrees to be folded upon the other half portion.

5. A fuse according to claim 4, in which each of said element holding portions are formed by folding a distal end portion of a piece portion extending from one end of said base material back upon a proximal end portion thereof.

6. A fuse according to claim 5, in which a projection is formed on the distal portion of said element holding portion, and projects toward the proximal end portion of the element holding portion.

* * * * *

UNITED STATES PATENT AND TRADEMARK OFFICE

CERTIFICATE OF CORRECTION

PATENT NO. : 5,818,320
DATED : October 6, 1998
INVENTOR(S) : MATSUOKA

It is certified that error appears in the above-identified patent and that said Letters Patent is hereby corrected as shown below:

On the Title page please insert Item

-- [30] Foreign Application Priority Data

October 8, 1996 [JP] Japan .....8-267470--

In the Abstract, line 1, delete "fuse having a";

insert --are-- after "terminals".

Signed and Sealed this

Twenty-seventh Day of April, 1999

*Attest:*

Q. TODD DICKINSON

*Attesting Officer*

*Acting Commissioner of Patents and Trademarks*